US005682944A

United States Patent [19]

Yamamoto et al.

[11] Patent Number: 5,682,944

[45] Date of Patent: Nov. 4, 1997

[54] REFRIGERANT CONDENSER

[75] Inventors: Michiyasu Yamamoto, Chiryu; Ken Yamamoto, Obu; Ryouichi Sanada, Kariya, all of Japan

[73] Assignee: Nippondenso Co., Ltd., Kariya, Japan

[21] Appl. No.: 494,596

[22] Filed: Jun. 23, 1995

Related U.S. Application Data

[63] Continuation-in-part of Ser. No. 155,227, Nov. 22, 1993.

[30] Foreign Application Priority Data

| | | | |
|---|---|---|---|
| Nov. 25, 1992 | [JP] | Japan | 4-314932 |
| Sep. 17, 1993 | [JP] | Japan | 5-231653 |
| Jun. 24, 1994 | [JP] | Japan | 6-142804 |

[51] Int. Cl.[6] ..... F28B 1/06

[52] U.S. Cl. ..... 165/110; 165/150

[58] Field of Search ..... 165/110, 150, 165/177

[56] References Cited

U.S. PATENT DOCUMENTS

| | | | |
|---|---|---|---|
| 4,141,409 | 2/1979 | Woodhull, Jr. et al. . | |
| 4,615,383 | 10/1986 | Aoki | 165/150 |
| 4,901,791 | 2/1990 | Kadle | 165/150 |
| 4,998,580 | 3/1991 | Guntly et al. | 165/133 |
| 5,190,100 | 3/1993 | Hoshino et al. . | |

FOREIGN PATENT DOCUMENTS

| | | | |
|---|---|---|---|
| 2-118399 | 5/1990 | Japan | 165/177 |
| 3-45300 | 7/1991 | Japan . | |
| 3-45301 | 7/1991 | Japan . | |

*Primary Examiner*—Allen J. Flanigan

*Attorney, Agent, or Firm*—Cushman, Darby & Cushman IP Group of Pillsvbury Madison & Sutro LLP

[57] ABSTRACT

A refrigerant condenser is set so that, if its condensation distance is L, the equivalent diameter of a tube having a linearly configured passage for the purpose of heat exchange is de (each dimension being in units of mm), and the number of times the direction change of the linearly configured passage for the purpose of heat exchange change is N, with de≦1.15 and the relationship L=(N+1)W=400+1,180 de to 700+1,180 de satisfied, a high heat exchange efficiency is achieved. In this refrigerant condenser, it is possible to use a single long winding tube.

4 Claims, 10 Drawing Sheets

REFRIGERANT CONDENSER

CROSS REFERENCE OF RELATED APPLICATION

This is a continuation-in-part application of the U.S. patent application Ser. No. 08/155,227 filed on Nov. 22, 1993.

BACKGROUND OF THE INVENTION

1. Field of the Invention

The present invention relates to a refrigerant condenser comprised of a pair of headers connected by a plurality of tubes, through which tubes a refrigerant flows in a serpentine manner.

2. Description of the Related Art

In the past, as this type of refrigerant condenser, provision has been made of a multiflow (MF) type refrigerant condenser such as the one shown in FIG. 8. That is, a pair of headers 1 and 2 are connected by a plurality of tubes 3 comprised of flat tubes. In the headers 1 and 2 are arranged separators at predetermined positions so that the refrigerant will flow in a serpentine manner through the tubes 3 between the headers 1 and 2.

In this case, to raise the heat exchange rate, Japanese Unexamined Patent Publication (Kokai) No. 63-161393 discloses a construction in which the number of times the refrigerant changes direction of flow in the headers 1 and 2 (hereinafter referred to as number of "turns") is set to one or more, while Japanese Unexamined Patent Publication (Kokai) No. 63-34466 discloses a construction in which the number of tubes making up the refrigerant passageway is reduced so as to reduce the cross-sectional area of the refrigerant passage from the inlet to the outlet.

In a refrigerant condenser comprised of a refrigerant passage which is turned back and forth as in the above-mentioned related art, however, if the number of turns of the refrigerant passage is increased to set the condensation distance large, while it is possible to increase the flow rate of the refrigerant and raise the heat exchange rate, the pressure loss inside the tubes increases, whereby the refrigerant pressure falls and along with this the problem arises of a fall in the condensation temperature. Therefore, when the number of turns of the refrigerant passage is set excessively large, the temperature difference between the outside air and the refrigerant becomes smaller, which is a factor behind a reduced heat exchange performance.

On the other hand, if the number of turns of the refrigerant passage is reduced to set the condensation distance smaller, while it is possible to decrease the pressure loss in the tubes, the flow rate of the refrigerant ends up falling, the heat exchange rate in the tubes becomes smaller, and the performance falls, which creates another problem. In view of the above, there assumingly is a number of turns of the refrigerant passage which is optimal for each heat exchanger.

The above-mentioned related art, however, merely suggest that increasing the number of turns of decreasing the sectional area of the passage contributes to an improved heat exchange rate. They do not go so far as to specify the optimal condensation distance for a heat exchanger and therefore do not solve the basic problem of improving the heat exchange rate.

SUMMARY OF THE INVENTION

To achieve the above-noted object, the present invention provides a refrigerant condenser having a pair of headers which form an inlet and an outlet for refrigerant, and at least one tube which forms an internal passage through which refrigerant is caused to flow, each of two ends of the tube being connected to each header, respectively, wherein at least part of the passage forms a linearly configured passage for the purpose of heat exchange, wherein if the number of times the direction change of flow of refrigerant within the tube in flowing toward the linearly configured passage for the purpose of heat exchange which is disposed downstream is N (an integer), the effective heat exchange width of the linearly configured passage for the purpose of heat exchange is W (in units of mm), the condensation distance of the refrigerant is L (in units of mm), and the equivalent diameter of the passage for the purpose of heat exchange is de (in units of mm), the equivalent diameter de of the passage is 1.15 or smaller, and further is set so as to satisfy the condition defined by the relationship;

$$\begin{aligned} L &= (N+1)W \\ &= 400 + 1{,}180\,de \text{ to } 700 + 1{,}180\,de \end{aligned}$$

To achieve the above-noted object, the present invention provides the above-noted refrigerant condenser wherein the tube is formed from long tube which is substantially jointless, the tube being bent so that its direction reverses over a prescribed width, so that it forms one or more winding tubes which have a plurality of the linearly configured passages for the purpose of heat exchange.

Furthermore, to achieve the above-noted object, the present invention provides a refrigerant condenser, wherein the equivalent diameter de (in units of mm) of which is in the following range.

$$0.60 \leqq de \leqq 1.15$$

To achieve the above-noted object, the present invention further provides a refrigerant condenser wherein the above-noted tube has a flat cross-sectional shape.

When the condensation distance L of the refrigerant condenser is set to a value calculated by the above-mentioned equation, the heat exchange rate of the refrigerant condenser becomes optimal, so by setting the number of turns of the refrigerant passage so that the above equation is satisfied, it is possible to obtain a refrigerant condenser with an optimal heat exchange rate.

BRIEF DESCRIPTION OF THE DRAWINGS

Other objects and effects of the present invention will become clearer from the following detailed description of embodiments made with reference to the drawings, in which.

DESCRIPTION OF THE PREFERRED EMBODIMENTS

Figure 1:
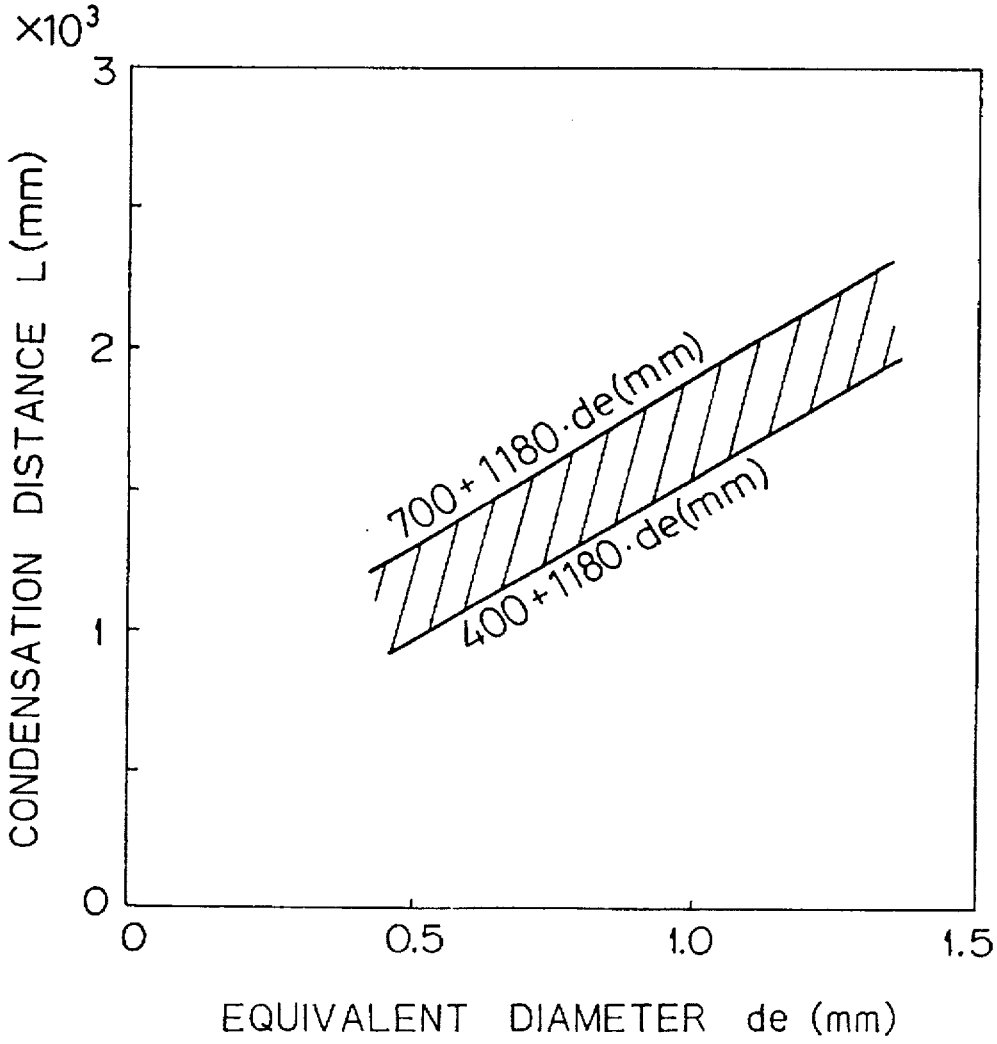
FIG. 1 is a view of the relationship between the equivalent diameter of the tubes and the condensation distance in an embodiment of the present invention.
Figure 2:
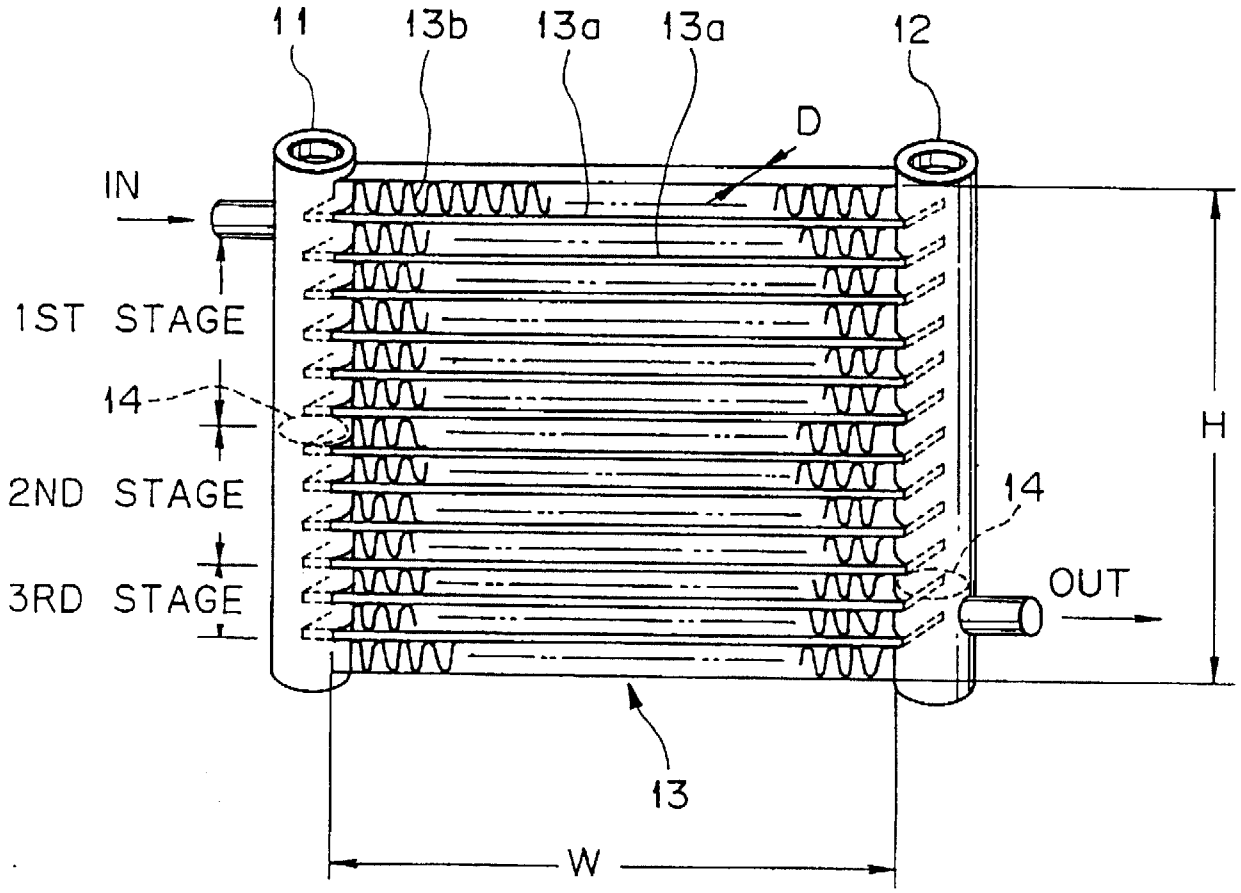
FIG. 2 is a schematic view of the construction of a heat exchanger.
Figure 3:
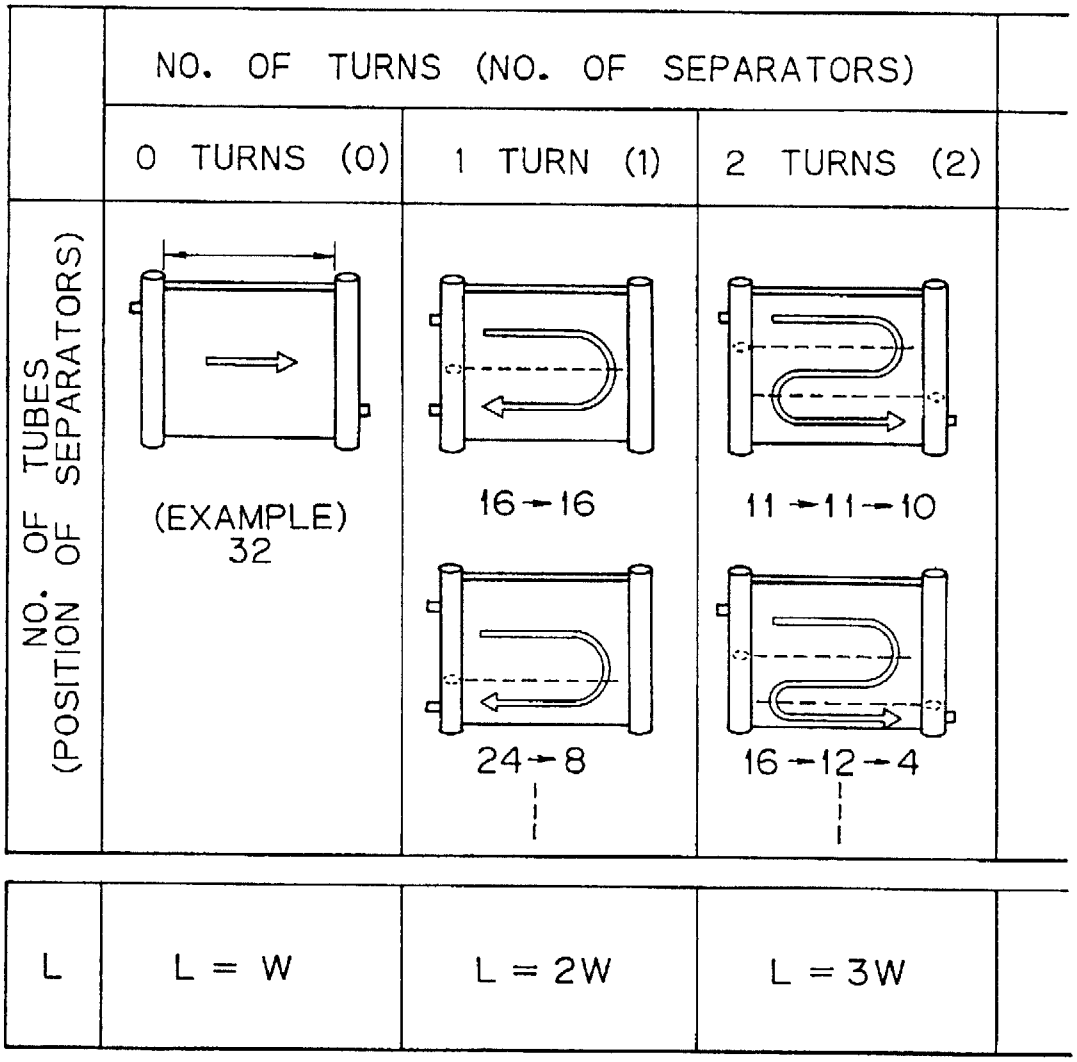
FIG. 3 is a view of the relationship between the number of turns of the refrigerant passage, the combination of the tubes, and the condensation distance.

Below, a first embodiment of the present invention applied to a refrigerant condenser of a car air-conditioner is described with reference to FIG. 1 to FIG. 7. FIG. 2 shows an MF type refrigerant condenser. In FIG. 2, a pair of headers 11 and 12 are connected by a core 13. The core 13 is comprised of a plurality of tubes 13*a* comprised of flat tubes between which are welded corrugated fins 13*b*. Separators 14 are disposed at predetermined positions in the headers 11 and 12. It is possible to set the number of turns of the refrigerant passage to any number as shown in FIG. 3 by the position of disposition of the separators 14. That is, when there are 32 tubes 13*a*, with 0 turns, all the 32 tubes 13*a* form a refrigerant passage oriented in one direction. In this case, the condensation distance L becomes W. Here, W is the distance between the headers 11 and 12 and matches with the lateral width of the core 13. With 1 turn, it is possible to set the tubes 13*a* to a combination of 16 and 16, a combination of 24 and 8, etc. In this case, the condensation distance L becomes 2W. Further, with 2 turns, it is, possible to set the tubes 13*a* to a combination of 11, 11, and 10, a combination of 16, 12, and 4, etc. In this case, the condensation distance L becomes 3W. FIG. 3 shows an example of a combination of the tubes 13*a*, but is possible to set any combination.

Figure 4:
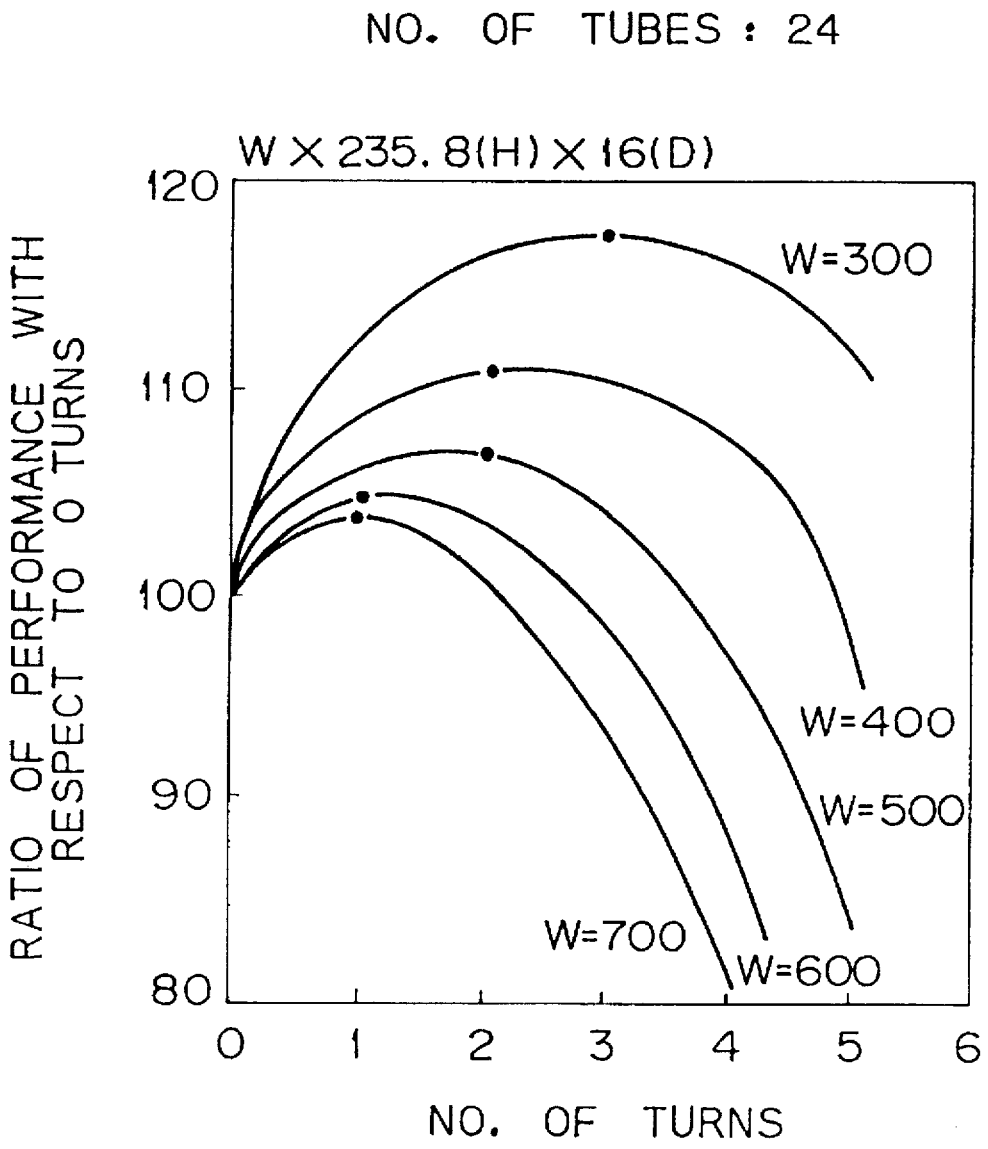
FIG. 4 is a graph of the relationship between the number of turns of the refrigerant passage and the ratio of performance with respect to 0 turns.
Figure 5:
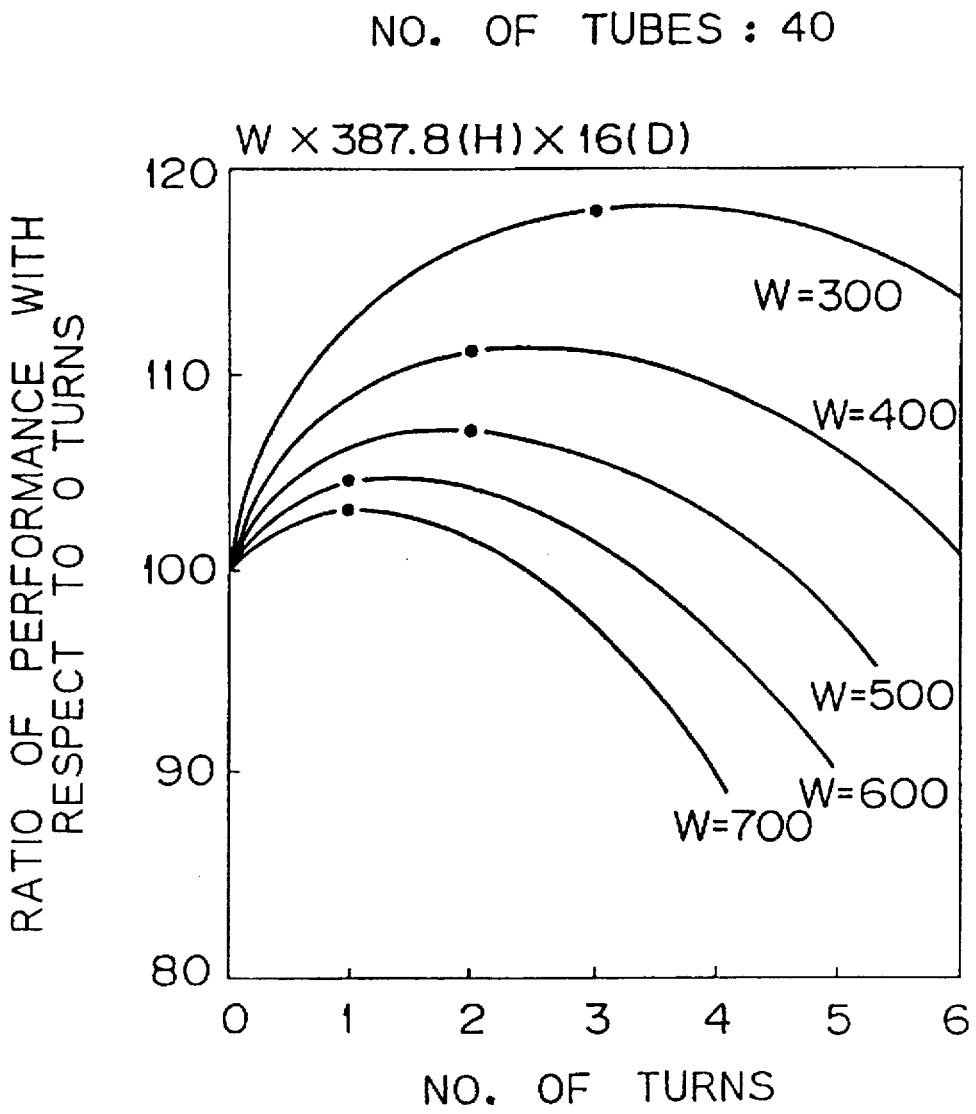
FIG. 5 is another graph of the relationship between the number of turns of the refrigerant passage and the ratio of performance with respect to 0 turns.

FIG. 4 and FIG. 5 show the trend in the number of turns of the refrigerant passage when the core size is set to various dimensions in the case of an equivalent hydraulic diameter de of the inside of the tubes 13*a* of 0.67 mm. That is, FIG. 4 shows the ratio of performance with respect to 0 turns when setting the core width W to from 300 mm to 700 mm in 100 mm increments and setting the number of turns of the refrigerant passage from 1 to 5 in a heat exchanger with 24 tubes 13*a*, a core height H of 235.8 mm, and a core thickness D of 16 mm (FIG. 2). FIG. 5 shows the ratio of performance with respect to 0 turns when setting the core width W to from 300 mm to 700 mm in 100 mm increments and setting the number of turns of the refrigerant passage from 1 to 6 in a heat exchanger with 40 tubes 13*a*, a core height H of 387.8 mm, and a core thickness D of 16 mm. The dots on the curves in FIG. 4 and FIG. 5 show the optimal performance points of each. The "equivalent diameter de" indicates hydraulic diameter corresponding to the total sectional area of the combined bores of a single tube 13*a*, since the shape of the tubes 13*a* is usually the sectional shapes shown in FIGS. 6A and 6B. That is, at a section of the tube 13*a* it is defined as de (equivalent diameter)=4×(total hydraulic sectional area)/(total wet edge length).

Here, various combinations of numbers of tube 13*a* are considered for various numbers of turns, but FIG. 4 and FIG. 5 show the ones with the optimal performance obtained as a result of calculation. That is, the performance of a condenser is determined by the balance of the improvement of the heat exchange rate and the pressure loss. The two have effects on each other, so it is possible to derive this by converting the relationship between the two to a numerical equation. Using this, it becomes possible to find the efficiencies of various heat exchangers. Further, for this calculation, detailed heat transmission rate characteristics and pressure loss characteristics were found by experiment and the results were used to prepare a simulation program and perform analysis. For the settings of the parameters at this time, the heaviest load conditions in the refrigeration cycle of a car air-conditioner were envisioned and use was made of an air temperature at the condenser inlet of 35° C., a condenser inlet pressure of 1.74 MPa, a superheating of the condenser inlet of 20° C., a sub-cooling of the condenser outlet of 0° C., an air flow of the condenser inlet of 2 m/s, and a refrigerant of HFC-134a. The analysis and the experimental findings were compared. As a result, the present inventor confirmed that the results of analysis and the experimental values substantially matched in the range of an equivalent diameter of the tubes 13*a* of 0.6 mm to 1.15 mm. Further, the inventor confirmed that the number of turns giving the optimal performance shown in FIG. 4 and FIG. 5 (optimal number of turns) is substantially the same even if the pitch of the fins differs or the core thickness D differs.

From FIG. 4 and FIG. 5, it is learned that so long as the core width W is the same, the optimal number of turns is the same even if the number of tubes 13*a* differs. This means if the core width is the same, the optimal number of turns is the same irregardless of the combination of the numbers of tubes 13*a*.

Figure 7:
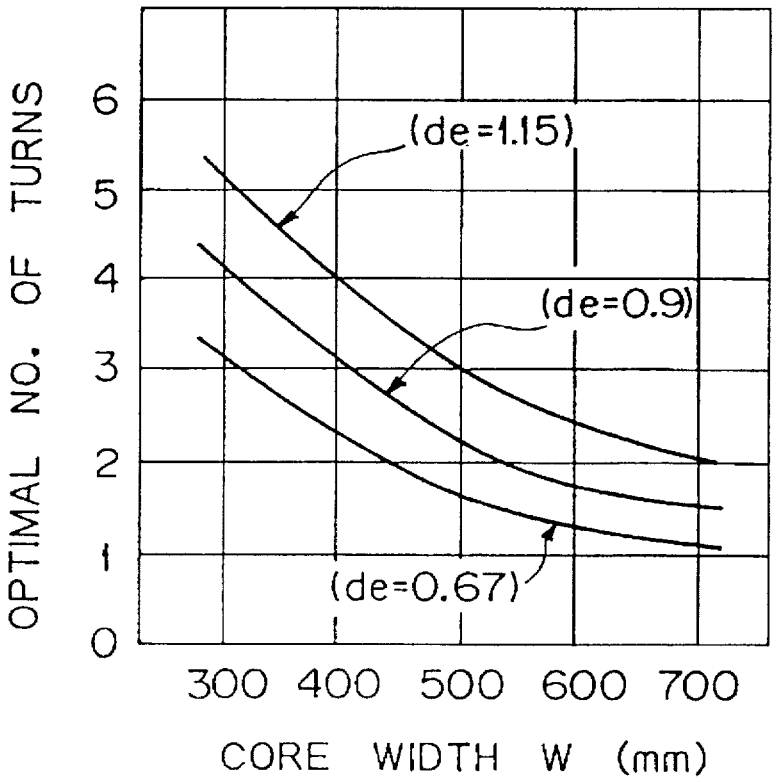
FIG. 7 is a graph of the relationship between the core width and the optimal number of turns.

FIG. 7 shows the results of the above calculation for tubes 13*a* of different equivalent diameters de to find the optimal number of turns for different core widths W. In this case, while there are only whole numbers of turns in actuality, regions other than those of integers are also shown so as to illustrate the trends.

Now then, in FIG. 7, looking at the tubes 13*a* with a de of 0.67 mm for example, the condensation distance L at the optimal number of turns is 3 when W=300 mm, so L=(3 (turns)+1)×300=1200 mm. When W=400 mm, it becomes 2 turns, so L=(2+1)×400=1200 mm. When W=500 mm, it becomes 2 turns, so L=(2+1)×500=1500 mm. When W=600 mm, it becomes 1 turn, so L=(1+1)×600=1200 mm. When W=700 mm, it becomes 1 turn, so L=(1+1)×700=1400 mm. Further, when the equivalent diameter de of the tubes 13*a* is 0.9 mm, the condensation distance L becomes 1500 mm when W=300 mm, 1600 mm when W=400 mm, 1500 mm when W=500 mm, 1800 mm when W=600 mm, and 1400 mm when W=700 mm. Further, when the equivalent diameter of the tubes 13*a* is 1.15 mm, the condensation distance L becomes 1800 when W=300 mm, 2000 mm when W=400 mm, 2000 mm when W=500 mm, 1800 mm when W=600 mm, and 2100 mm when W=700 mm. Usually, the core width W of a refrigerant condenser used for a car air-conditioner is about 300 mm to 800 mm, so from the results of the above calculations, it is learned that when the equivalent diameters de of the tubes 13*a* are the same, there is not that much effect on the core width W and the optimal condensation distance L lies in a certain range.

Therefore, it is possible to specify the optimal condensation distance L for an equivalent diameter de of tubes 13*a*. FIG. 1 shows the results when changing the equivalent diameters de and finding by the above analysis the range of the optimal condensation distances L for those de. Linear approximation of the data obtained enables the optimal condensation distance L to be set as $$L=400+1{,}180\ de \text{ to } 700+1{,}180\ de \quad (1)$$

where the units of L and de are millimeters.

Therefore, if the equivalent diameter de of the tubes 13*a* of the core 13 of the heat exchanger is known, it is possible to find the optimal condensation distance L from equation (1), so it becomes possible to set the optimal number of turns (N) by finding the number of turns matching that condensation distance from the following equation (2):

$$N \text{ (number of turns)}=L/W-1 \quad (2)$$

Further, since the number of turns must be an integer, it is necessary to round off the number of turns found from equation (2).

Figure 9:
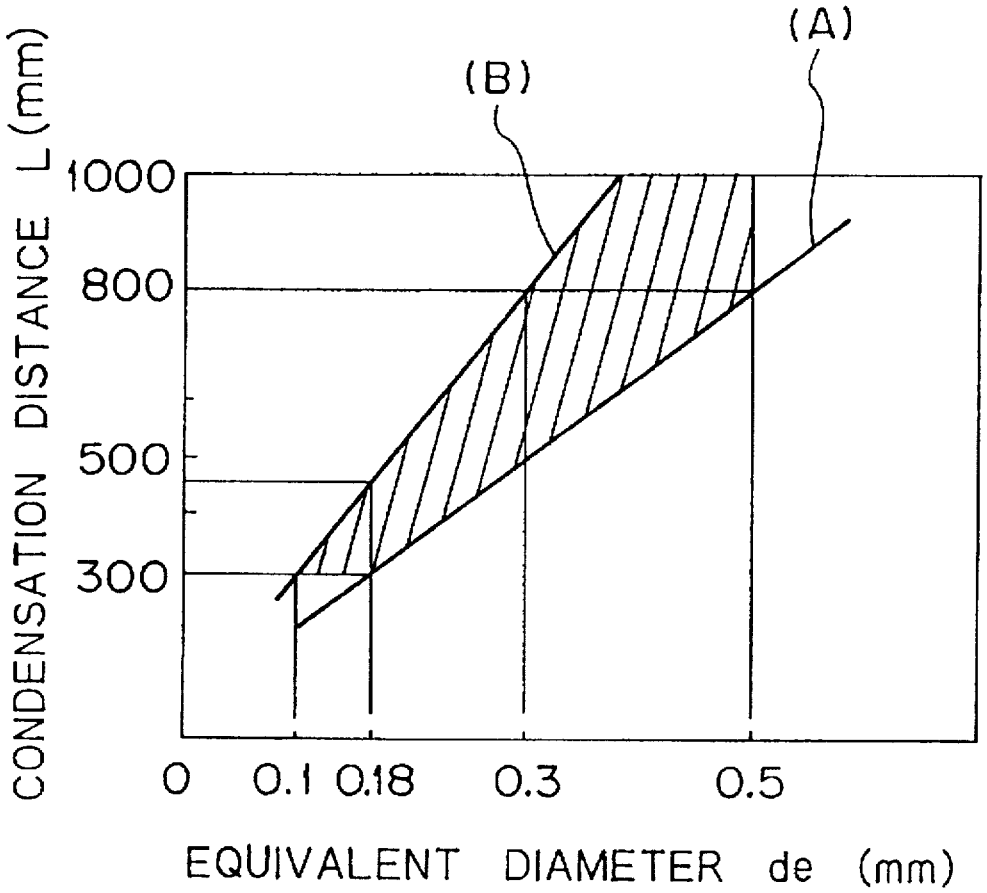
FIG. 9 is a view of the relationship between the equivalent diameter of tubes and the condensation distance in tubes with a small equivalent diameter.

In recent years, advances in the manufacturing technology for tubes of refrigerant condensers have made possible the production of tubes with extremely small equivalent diameters. If the above equation (1) is applied to such very small tubes, the number of turns is set to 0. For example, FIG. 9 shows the results obtained by using the above-mentioned simulation program to find the optimal condensation distance at an idle high load (A) and a 40 km/h constant load (B) for tubes with an equivalent diameter de of less than 0.60 mm. Looking at just the line of the idle high load (A), when the equivalent diameter is 0.18 mm to 0.5 mm, the optimal condensation distance L becomes 300 to 800 mm, so as mentioned above, 0 number of turns is the optimal specification when the core width W is 300 mm to 800 mm.

In this way, by making the tubes ones with an equivalent diameter of 0.18 mm to 0.5 mm, it is possible to provide a refrigerant condenser with a good efficiency with 0 number of turns. A condenser with 0 number of turns does not require any separators for dividing the headers, so the work of inserting the separators and the process of detecting leakage of refrigerant from the separator portions become unnecessary. Further, it becomes possible to simplify and standardize the shape of the header portions. Further, compared with the case of use of tubes with a large equivalent diameter as shown in FIG. 9, the fluctuation in the optimal condensation distance due to load fluctuations becomes smaller, so it is possible to maintain the optimal state for the load conditions even if the load conditions fluctuate.

The second embodiment of the present invention will now be described. While the second embodiment can be said to be similar to the refrigerant condenser according to the first embodiment, in a prior art multiflow-type refrigerant condenser shown in FIG. 8, a plurality of straight flat tubes 3 oriented in the left-to-right direction, are mounted so as to form a bridge across a pair of headers 1 and 2, which are disposed in a vertical orientation, this plurality of flat tubes 3 being grouped into a plurality of groups and forming a winding passage through which refrigerant flows. Corrugated fins which aid heat exchange are laminated between the above-noted flat tube 3.

Because of the above-noted construction, in manufacturing the above-noted structure, it is necessary to provide a large number of cutouts to define opening which are spaced and juxtaposed at a predetermined distance on the opposed surfaces of the tubular headers 1 and 2; to insert many flat tubes 3 into these openings, and to laminate corrugated fins between these flat tubes 3 and then to join these together as one by means of brazing, or the like.

However, in the manufacturing process for such a refrigerant condenser, in order to prevent leakage of refrigerant at the cutout openings in the headers 1 and 2, it is necessary to provide reliable joining, and there are many locations which must be joined with care, thus making the assembly task troublesome, and increasing the manufacturing cost accordingly.

In the second embodiment of the present invention, a long flat tube with no joints is snaked back and forth so as to reduce the number of joints between the headers and the flat tube, thereby solving the above-noted problem. It goes without saying that the structure itself of a heat exchanger having a long tube which changes direction back and forth belongs to the prior art. However, the second embodiment of the present invention differs from this type of heat exchanger in the prior art in that it applies a feature of the present invention as disclosed in the description of the first embodiment.

Figure 10:
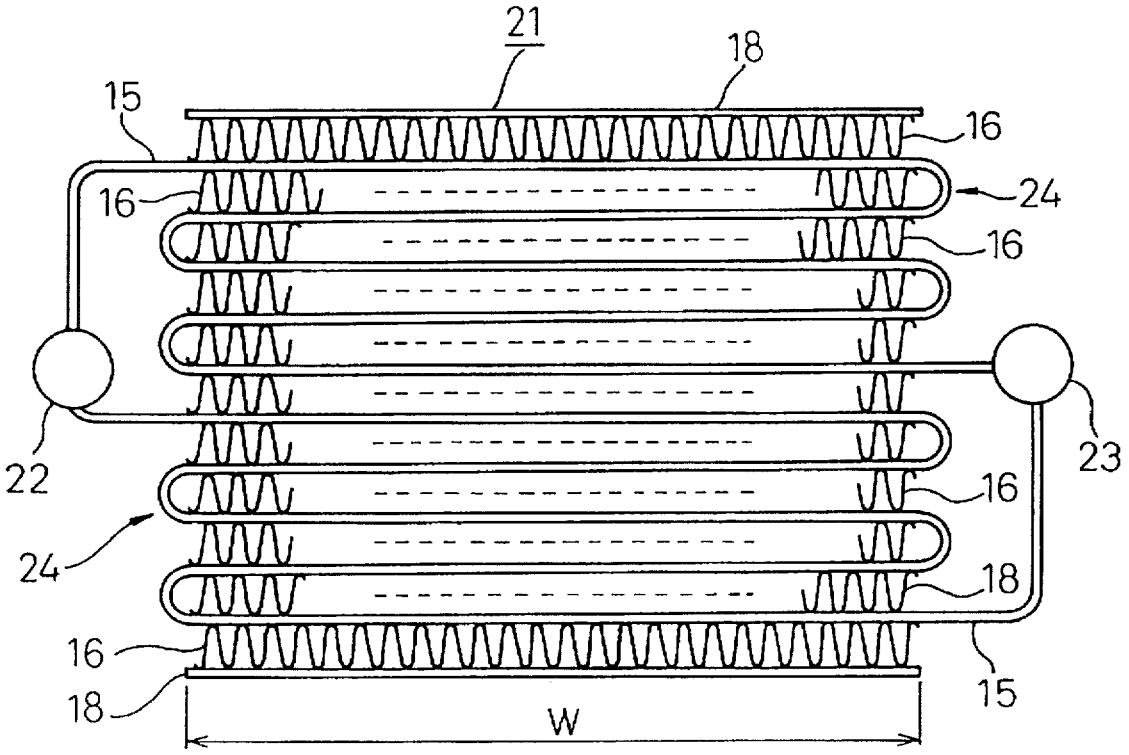
FIG. 10 is a schematic view of the construction of a heat exchanger of the second embodiment of the present invention.

FIG. 10 is a simplified drawing which shows the overall construction of the refrigerant condenser 21 according to the second embodiment of the present invention. In this refrigerant condenser 21, two tubes 24, for example, which change direction back and forth are joined at both ends to a pair of headers 22 and 23 which are positioned at the left and right as shown in FIG. 10. In this case, the headers 22 and 23 can be short and tubular in shape, with one header 22 forming an inlet for the purpose of taking in high-temperature, high-pressure gas refrigerant from a compressor (not shown in the drawing) in the refrigeration cycle, and the other header 23 forming an outlet for the purpose of discharging liquid refrigerant to a receiver (not shown in the drawing). There are only two locations each at which the ends of the snaking tubes 24 are mated with the outer surfaces of the headers 22 and 23. In addition, end plates 18 are mounted to the top and bottom end parts of the refrigerant condenser 21.

Figure 6A:
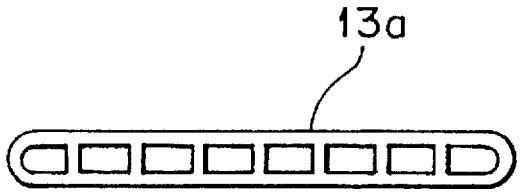
FIGS. 6A and 6B are sectional views of the core tubes.
Figure 6B:
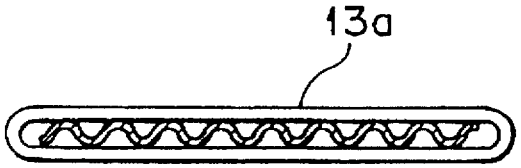

More specifically, the winding tubes 24 used in the second embodiment of the present invention are similar to the flat tube 13*a* shown in FIG. 6A or FIG. 6B, a long, jointless flat tube 15 having an equivalent diameter of de being reversed in direction a prescribed number of times in a prescribed width to form these tubes. The number of changes of direction N of the winding tube 24 shown in the refrigerant condenser 21 of FIG. 10 is 4, so that each of the jointless flat tubes 15 is bent to form a five-step lamination. Corrugated fins 16 are mounted, using brazing or the like, over approximately the entire left-to-right expanse between mutually opposing parts of the winding tube, these serving to aid in heat exchange. In this case, because the corrugated fins 16 provided on the two jointless flat tubes 15 perform heat exchange particularly effectively, the left-to-right width of this part of the two jointless flat tubes 15 perform heat exchange particularly effectively; the left-to-right width of this part of the two jointless flat tubes 15 is defined as the effective heat exchange width W, and because this has the same significance as the distance between the headers 11 and 12, that is, the core width W in the first embodiment, these can be treated as being equivalent. In the case of the second embodiment, the equivalent diameter de of the flat tube 15 is selected in the range from 0.6 to 1.15 mm, as is the case for the first embodiment.

In a refrigerant condenser 21 having a construction as described above, as is the case with the first embodiment, if the condensation distance is L, the number of changes of direction of the tubes 24 is N (an integer), the effective heat exchange width is, for the reason noted above, W, and the equivalent diameter within the flat tube 15 is de, all these being in units of millimeters, these values are established so as to satisfy the following equation, which has the same significance as equation (1) which was presented with regard to the first embodiment.

$$L = (N+1)W = 400 + 1{,}180\,de \text{ to } 700 + 1{,}180\,de$$

In terms of specific values, if for example the number of direction changes N of the winding tube 24 is 4, and the equivalent diameter de within the flat tube is 0.9 mm, the effective heat exchange width W is set in the range 290 to 350 mm. It is, of course, possible to set the valve of equivalent diameter de anywhere as desired in the range $0.60 \leqq de \leqq 1.15$, and to set the number of direction changes N and the effective heat exchange width W to any of a variety of values which satisfy the above relationship.

As described above, in a refrigerant condenser for use in a vehicular air conditioner, the core width is generally set in the approximate range of 300 to 800 mm, with the number of direction changes N set accordingly to a value from 1 to 7. The number of winding tubes 24 in the refrigerant condenser is set to a value which is based on the required amount of refrigerant.

Figure 8:
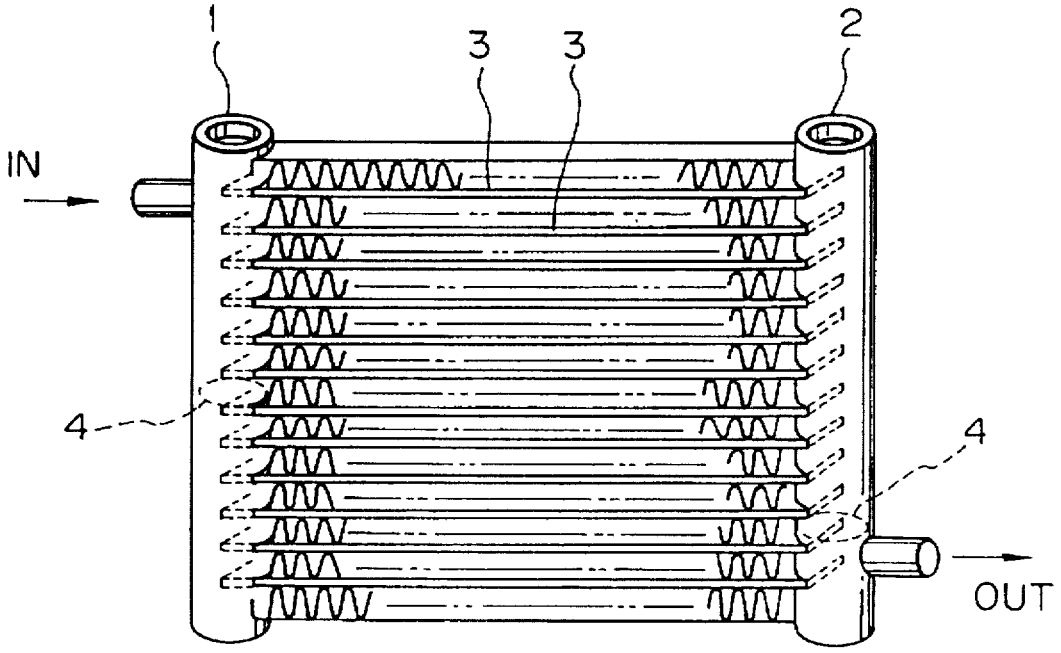
Fig. 8 PRIOR ART
FIG. 8 is a schematic view of the construction of a heat exchanger in the related art.

Compared with a refrigerant condenser as shown in FIG. 8, in which a large number of straight flat tubes 3 are passed across the space between two headers 1 and 2, with separators 4 provided inside the headers to achieve the required number of direction changes N, in a refrigerant condenser 21 according to the second embodiment, which has a construction as described above, because only the two ends each of two winding tubes 24, formed by causing a flat, jointless tube 15 to change directions N times, are connected to the pair of headers 22 and 23, not only is just a small number of winding tubes 24 required, but also the number of joining locations between the winding tubes 24 and the headers 22 and 23 is drastically reduced. Other advantages are the simplification of the manufacturing process by, for example, the elimination of the need for separators inside the headers 22 and 23 and a reduction of the dimensional accuracy required in elements such as the corrugated fins 16, all these acting to reduce the manufacturing cost.

Figure 11:
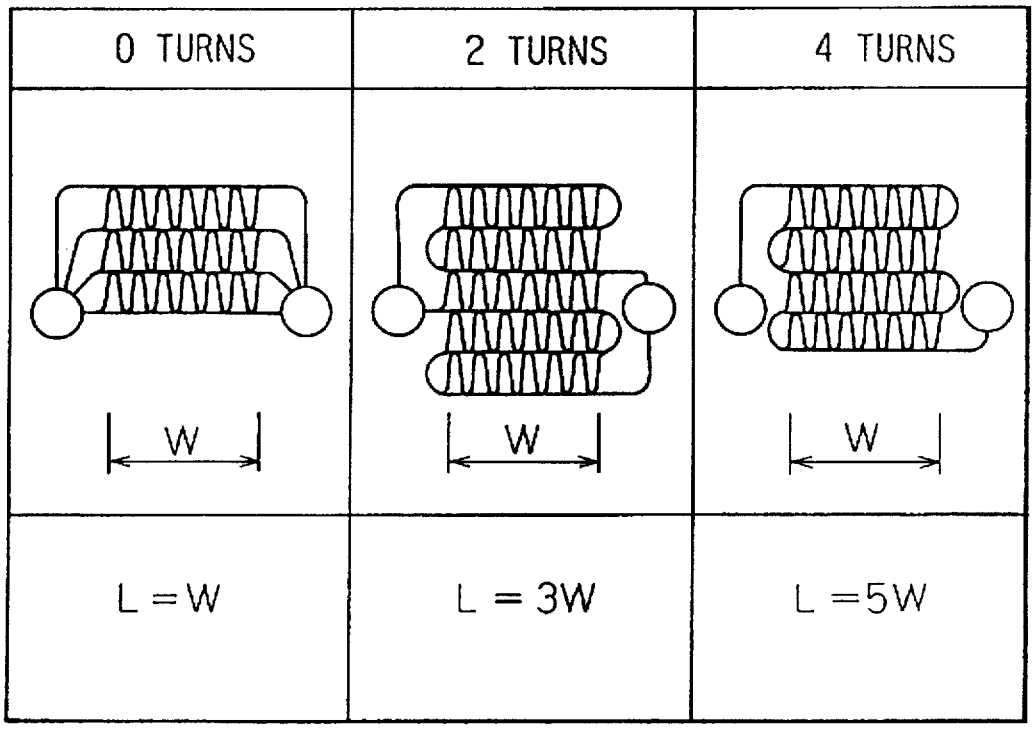
FIG. 11 is a view of the relationship between the number of turns of the back-and-forth winding tube and the condensation distance.

FIG. 11 illustrates examples of variations of the second embodiment, with different numbers turns N and varied condensation distance L. In this drawing, W indicates the effective length of the straight part of the winding tube 24, that is, the effective heat exchange width. While all of the variations shown in FIG. 11 use an even number of turns N, an odd number of turns can, of course, be used if two headers are provided on the same side.

As explained above, in the present invention, the optimal condensation distance L is determined from the equivalent diameter de of the tubes 13*a* of the core 13 of the heat exchanger and the optimal number of turns of the refrigerant passage is found from the condensation distance L, so the present invention differs from the related art, which only suggested that an increase of the number of turns or a decrease of the sectional area of the passage contributed to an improvement of the heat exchange rate and therefore it is possible to design a heat exchanger with a high heat exchange rate.

We claim:

1. A refrigerant condenser for use in a vehicle air-conditioner, the condenser comprising:

a pair of headers which form an inlet and an outlet for refrigerant, and at least one tube which forms an internal passage through which refrigerant is caused to flow, said at least one tube being connected to each header, wherein at least part of said passage forms a linearly configured passage for the purpose of heat exchange, wherein when the number of times the direction change of flow of refrigerant within said tube in flowing toward the linearly configured passage is N, the effective heat exchange width of said linearly configured passage is W (in units of mm), the condensation distance of the refrigerant is L (in units of mm), and the equivalent diameter of said linearly configured passage is de (in units of mm), the width W being within the range of 300 to 800 mm, the equivalent diameter de of said linearly configured passage is 1.15 or smaller, and further is set so as to satisfy the condition defined by the relationship $$L = (N+1)W = 400 + 1{,}180\,de \text{ to } 700 + 1{,}180\,de,$$

with the number N being an integer rounded from the expression (L/W)−1.

2. A refrigerant condenser according to claim 1, wherein said tube is formed from long tube which is substantially jointless, said tube being bent so that its direction reverses over a prescribed width, so that it forms one or more winding tubes which have a plurality of said linearly configured passages for the purpose of heat exchange.

3. A refrigerant condenser according to claim 2, wherein the equivalent diameter de (in units of mm) of said tube satisfies the relationship $0.60 \leqq de \leqq 1.15$.

4. A refrigerant condenser according to claim 2, wherein said tube has a flat cross section.

* * * * *